United States Patent [19]

Rolffs

[11] Patent Number: 4,840,637

[45] **Date of Patent: * Jun. 20, 1989**

[54] SYNTHETIC EBONY AND METHOD OF PRODUCING THE SAME (I)

[76] Inventor: Philip C. Rolffs, 629 South Shore Dr., P.O. Box 175, Portage, Mich. 49081

[ * ] Notice: The portion of the term of this patent subsequent to Jun. 20, 2006 has been disclaimed.

[21] Appl. No.: 206,190

[22] Filed: Jun. 10, 1988

Related U.S. Application Data

[63] Continuation of Ser. No. 933,478, Nov. 21, 1986, abandoned.

[51] Int. Cl.[4] ..... D06P 3/60

[52] U.S. Cl. ..... 8/402; 8/506

[58] Field of Search ..... 8/402

[56] References Cited

U.S. PATENT DOCUMENTS

| | | | |
|---|---|---|---|
| 209,568 | 0/1878 | Hyatt | 8/402 |
| 1,774,940 | 9/1930 | Mengel | 8/402 |
| 2,391,613 | 12/1945 | Black | 8/402 |
| 3,695,920 | 10/1972 | Hill | 8/402 |

FOREIGN PATENT DOCUMENTS

| | | |
|---|---|---|
| 3344973 | 6/1985 | Fed. Rep. of Germany . |
| 0152427 | 10/1920 | United Kingdom . |

*Primary Examiner*—Paul Lieberman
*Assistant Examiner*—John F. McNally
*Attorney, Agent, or Firm*—Gordon W. Hueschen

[57] ABSTRACT

A process of treating wood of the genus Juglans to change its color completely and throughout its entire structure and substance so as to produce a jet black product with bronze highlights which duplicates the color of natural ebony, thereby providing a highlighted synthetic ebony or ebony substitute, and the product produced thereby, are all described herein.

16 Claims, No Drawings

SYNTHETIC EBONY AND METHOD OF PRODUCING THE SAME (I)

This is a continuation of application Ser. No. 933,478 filed Nov. 21, 1986 now abandoned.

BACKGROUND OF THE INVENTION

1. Field of Invention

Wood of the genus Juglans which is jet black completely and throughout its entire structure and substance, except for bronze highlights, thereby providing a highlighted ebony substitute, and method of producing the same.

2. Prior Art

There is a dwindling availability of natural ebony. *Diospyros ebenum,* or Ceylon Ebony, which is considered to be the finest and blackest variety, is virtually unobtainable in lumber form and is available on a limited basis in small dimension stock only. Diospyros spp., or Nigerian Ebony, the most commonly used black ebony, is available only in small boards which generally contain numerous defects. The supply of this wood is unreliable and its quality is generally poor (7). The cost of natural ebony is very high, being about eight times the price of walnut, an available domestic wood which can conveniently be employed as starting material for the present invention.

Natural ebony has been a rare, expensive, and highly-prized wood since ancient times. There has never been a sufficient supply available to enable its extensive use in furniture construction or other large works. Most uses of ebony have therefore been for such purposes as decorative inlay work, small accessory furnishings, musical instrument parts, fancy handles, piano keys, and the like (2, 4).

Although problems of supply, quality, and cost preclude the use of ebony in furniture and many other products, the popularity of, and demand for, "ebony colored" wood and wood substitutes has been, and continues to be, very strong. This is evident from many examples seen in furniture, accessory furnishings, musical instruments, sporting goods items, cutlery, and other products. The term "ebonized finish" is often used in reference to the finishes on these items.

The demand for ebony color is met in various ways including surface coloring of white woods by painting or staining them black, the use of black plastics, and the use of white woods impregnated with black dyes, black dye/resin combinations, or chemicals. None of these methods provides a satisfactory ebony substitute and all have various shortcomings. Painted surfaces do not look like wood. Stained wood falls short of the quality of appearance which is obtained in wood which is finished in its natural color without the use of stains. Both finishes are easily abraded or damaged, revealing the underlying white wood. Plastics are unsatisfactory substitutes.

Several methods have been devised over the years to color-impregnate wood with various colors, including black. These methods fall into the following general classifications: dye impregnation, dye/resin impregnation, dye/resin impregnation and compression of wood, and chemical impregnation. In the areas of dye impregnated and dye/resin impregnated woods, when black colors are produced, they lack the intensity of the black color of natural ebony (3). It has also proven impossible to completely impregnate woods with these substances (8). There always remain certain areas in the wood which are impervious to the dyes or dye/resin combinations. This results in unattractive colored streaks being visible in the finished material. Ray cells are particularly impervious to dyes and areas of ray fleck figure are present in much of the wood which remains undyed. In an effort to overcome these difficulties, methods have been developed to dye thin sheets of wood veneer, these being more readily impregnated than lumber (8), and then to laminate the veneer sheets into stock of the desired thickness. This material is in common use in the archery industry for bow handles (9), but still fails to overcome the previously-noted shortcomings of dye-impregnated woods. In addition, it has the objectionable characteristic of looking like plywood, which is what it is. This material is suitable for certain specialized applications but its use is not widespread, and it most assuredly is not considered to be an ebony substitute.

In the area of dye/resin impregnated and compressed wood, in a material generally known as "Compreg", more intense colors than those of previously-described materials are generally achieved. However, the problems associated with dye-impregnated wood, especially unimpregnated areas, remain in this material. In addition, it has the objectionable characteristics of looking like plywood, being extremely hard and heavy, being very brittle, and consisting more of resin than of wood. This material is in common use in the cutlery industry for handle material. However, its use is even more restricted than that of the previously-described laminated material and it is likewise not considered to be an ebony substitute.

The area of chemical impregnation of wood to change its color, as it relates to creating a black color, is discussed further hereinafter. Such processes produce colors with the characteristics of natural wood colors, in that the colors are imparted into the cell structure of the wood and are not laid on the wood surface as are stains. Such woods, when finished, have the same quality of appearance as woods finished in their natural colors without the use of stains. While the foregoing procedure will produce wood materials with gray, or gray black color, it has proven impossible to duplicate the intense black color of natural ebony with this procedure, for reasons further explained hereinafter.

The desirable characteristics of the finest natural ebony include, in addition to the primary characteristic of its color, susceptibility of polish, hardness, and durability (2,4).

Natural ebony also has certain undesirable characteristics that include excessive hardness, excessive weight, brittleness, difficulty of machining causing it to be hard on cutting tools, excessive degrade due to the numerous defects which it contains, availability in small dimensions only, inadequate and unreliable supply, and excessive cost.

The finest grade of natural ebony is generally considered to be the species *Diospyros ebenum,* or Ceylon Ebony. This ebony is believed to excel all other varieties in the fineness, uniformity, depth, and intensity of its black color (4). Heretofore it has been impossible to duplicate this color in artificially color-impregnated wood materials.

The prior art, to the extent of my knowledge from studies and searches, is as follows:

(I) Ebonized oak, a process of surface treating oak lumber with an aqueous solution of ferrous acetate (11), in which the iron in the solution reacts with tannin in the oak, forming ferric tannate, a compound of variable composition and of bluish-black color. This imparts a bluish-black or bluish-gray color to the wood surface. An aqueous solution of ferrous sulfate can be used in place of ferrous acetate.

(II) Surface treatment of white woods with an aqueous solution of tannic acid, followed by a surface treatment with an aqueous solution of ferrous sulfate. This process likewise forms ferric tannate and imparts a gray to gray-brown to gray-black color to the wood surface.

(III) Impregnation of white woods with aqueous solutions of tannic acid and iron salts (1,13). This process forms tannic acid on the wood surface and on its interior portions. It imparts colors ranging from gray to gray-black to black. However, this process will not impart a black color with the deep intensity of the black color of natural ebony. The reasons for this are not understood, but may have to do with the fact that a given volume of wood has a very large surface area within it due to its microscopic cellular structure, and it may not be possible to introduce enough tannic acid to effectively cover this surface area. In numerous experiments which I have conducted on permeable woods, which are most readily impregnated, using the tannic acid-iron salt solution process, I have been unable to achieve an intense black color using prior art procedure.

The art of impregnating wood is well known and widely practiced in industry. However, the complete impregnation of the entire structure and substance of woods is neither known nor practiced. It is of course not necessary or desirable in the wood preservation industry (12). It is not achieved in dye or dye-resin impregnated wood, as evidenced by the uncolored, unimpregnated areas which still remain in these products.

Due to the shortcomings of all of these available procedures, the art has taken to dye and dye resin impregnated woods but here, as previously stated, the intense black color of ebony has not been duplicated to date (3) and, moreover, complete impregnation of woods with such substances has proven impossible (8).

Additional comments concerning patents turned up in a patent search relating to the subject of this invention are as follows:

Spicker, U.S. Pat. No. 3,635, 1844, discloses and claims an "Improved Method For Coloring Wood". The method there described does not provide complete coloring throughout the structure of the wood, cannot be employed to produce a totally black product, even using thin pieces of veneer, does not provide an economic or commercially feasible process, does not specify the species of wood to be employed, can only produce pastel or medium color shades and certainly cannot be employed to produce an ebony substitute.

Spade, British Patent No. 152,427, 1920, discloses and claims impregnation of wood with tannin, followed by iron salt, then necessarily supplemented with a dye. Claims production of a wood product which is uniformly black throughout. Requires the employment of ammonia and thereafter a logwood extract and cannot be used to produce a totally black wood product suitable as an ebony substitute. It also discloses use of ferrous acetate after capeachy extract plus soap solution, which also cannot be used to produce a wood which is sufficiently black throughout to be employed as an ebony substitute.

Lentz, U.S. Pat. No. 1,809,980, 1931, discloses the employment of ammonia gas to color a white wood a brown or walnut color, thereby producing a walnut substitute. U.S. Pat. No. 929,015 roughly covered the same idea in 1909.

Black, U.S. Pat. No. 2,391,613, 1945, discloses the dyeing of wood by impregnation with an azo pigment and forming the pigment within the wood structure.

Hill, U.S. Pat. No. 3,695,920, 1972, describes the surface-coloring of wood with pigments prior to using the wood for impregnation with wood-preservative chemicals.

Hyatt, U.S. Pat. No. 209,568, 1878, discloses a surface treatment of wood with tannin derived from logwood extract followed by a treatment with tincture of muriate of iron or use of the same two substances together as a stain. This patent applies a basic idea which predated the patent by many, many years.

Hall, U.S. Pat. No. 939,015, 1909, discloses impregnation of white wood with ammonia gas to impart an oak appearance to white wood and uses heat and vacuum to extract air and moisture from the wood being treated. This patent discloses the same idea as U.S. Pat. No. 1,809,980, approximately twenty-two years later.

Hall, U.S. Pat. No. 964,017, 1910, discloses the impregnation of white wood with metallic salts so that the salts react with the tannin found naturally in the wood to produce a "light" shade of color different from the natural wood and produce a ring-developed or figured effect in woods in which the "grain is comparatively inconspicuous". Silver grays and light browns are the colors of the ultimate product.

Farber, U.S. Pat. No. 2,517,296, 1950, discloses a method of changing walnut sapwood, which is white, to a color closely resembling the walnut heartwood, which is brown, by immersing the wood in an aqueous solution of hydroquinone for two to sixty hours and thereafter exposing the wood to ammonia vapor.

Mengel, U.S. Pat. No. 1,774,940, 1930, discloses a method of changing the color of walnut sap veneer, which is white, to the color of walnut heartwood, which is brown, by soaking the veneer in a solution of tannic acid and iron salt thereby to turn the color of the walnut sapwood into the color of the walnut heartwood. The treated veneer is only 1/28th inch thick.

Hall, U.S. Pat. No. 924,770, 1909, discloses the impregnation of white wood with a dye which is made from phlobaphenes of hemlock or oak bark, which are byproducts in the production of extracts for the tanning industry. The colors achieved are various shades of brown.

Dunn, U.S. Pat. No. 3,685,959, 1972, discloses the impregnation of wood with halogenated hydrocarbon solvents or polyethylene glycol plus desired preservatives and dyes, fire retardants, and what have you.

Simatupang, DE No. 3,344,973, published in 1985, discloses a surface wood stain comprising tannin, a ferrous salt, an ammonium salt, and a water-soluble polyhydric alcohol.

Bouwman, U.S. Pat. No. 1,447,528, on an application filed in 1922, discloses a method of fixing dyes into wood which has been impregnated with an aqueous dye solution which makes it possible to compress the wood without driving out the dye.

Hall, U.S. Pat. No. 939,016, 1909, discloses a method of color-impregnating wood with dyes in which the step of steaming or boiling is employed.

Nack, U.S. Pat. No. 2,867,493, 1959, discloses a process of pretreating a wood surface so that subsequent dye application causes reaction with the chemical left from the first pretreatment step, resulting in a surface-stained wood.

Williams, U.S. Pat. No. 3,622,380, 1971, discloses a method of coloring white wood a walnut color involving employment of furfuryl alcohol, a metallic compound acting as catalyst, and a complexing agent such as lactic acid or ammonium chloride. The claimed color impregnation is effected by soaking one inch by one inch samples of veneer in the solution.

From the foregoing, it is clear that the prior art has not provided any suitable or satisfactory ebony substitute, whether highlighted or essentially devoid of highlighting, or any method of producing the same, much less such a method which is economically and commercially feasible, generally applicable to large wood sizes, equivalent throughout its composition and substance to ebony in its degree of jet black color, darkness, depth, and intensity, which is stable and with no tendency for color bleed-out or fading. It also is apparent that the expense and relative unavailability of natural highlighted ebony, despite the efforts of the prior art and in view of the obvious shortcomings of the prior art, now places a suitable and satisfactory highlighted ebony substitute, such as is provided by the present invention, and an economic and commercially-feasible process for the production thereof, into the category of a "long-awaited" development, especially since efforts to produce satisfactory ebony substitutes have continuously been made over a period of at least 100 years without any substantial measure of success.

OBJECTS OF THE INVENTION

It is an object of this invention to provide a method of treating wood of the genus Juglans to render it completely jet-black in color throughout its entire structure and substance, except for bronze highlights, and to impart to the wood certain other desirable characteristics. It is a primary object of the invention to provide a wood material which possesses certain desirable characteristics, especially a jet-black color of such fineness, uniformity, depth, and intensity, and with desirable bronze highlighting, so that the wood can be used as a substitute for natural highlighted ebony. Another object is to provide an ebony substitute which possesses the necessary physical characteristics, which is available at a relatively low price, and which is available in ample supply so that its use can be expanded beyond the current uses of natural ebony. An additional object is to provide a highlighted ebony substitute which is a solid wood material and which is completely natural in appearance and other obvious physical characteristics. Still a further object is to provide a highlighted ebony substitute which, in addition to color, in addition to color, emulates other desirable physical characteristics of natural ebony. Still an additional object is to provide a highlighted ebony substitute which overcomes certain undesirable physical characteristics of natural ebony. Yet another object is to provide a method or procedure whereby it is possible to completely impregnate wood of the genus Juglans with suitable chemical materials or solutions which will impart a desired highlighted jet black color and other characteristics throughout the entire structure and substance of the wood. Still further objects will become apparent hereinafter and yet additional objects will be apparent to one skilled in the art.

SUMMARY OF THE INVENTION

The invention, then, comprises the following, inter alia:

A method of treating wood of the genus Juglans to change its color completely and throughout the entire structure and substance thereof essentially to jet black, with bronze highlights, thereby providing a highlighted ebony substitute, comprising the following steps:

placing the starting wood into a vacuum/pressure vessel, drawing a vacuum in the vessel, preferably raising the temperature of the contents of the vessel, allowing the vessel to stand until essentially all the extractable water and air is extracted from the wood, introducing an aqueous solution of an iron salt having a concentration not greater than about eighteen percent (18%) by weight into the vessel, while maintaining the vacuum therein, thereafter preferably maintaining an elevated temperature and applying an elevated pressure inside of the vessel, allowing the vessel to stand until essentially the maximum possible amount of iron salt solution is absorbed by said wood, if necessary reducing the temperature of the contents of the vessel to ambient temperature, releasing the pressure in the vessel, draining fluid from the vessel, removing the wood from the vessel, washing the wood with water, and drying the thus-treated wood to produce a jet black synthetic ebony product having bronze highlights; such a method wherein the vacuum is monitored by means of a vacuum gauge during the vacuum step of the method and wherein the vacuum is reapplied at intervals over a period of several hours until a stable equilibrium is obtained as evidenced by a stable vacuum gauge reading; such a method wherein the pressure is monitored during the pressure step of the method and wherein the pressure is reapplied at intervals over a period of several hours until the pressure stabilizes as indicated by a stable pressure gauge reading; such a method wherein the aqueous iron salt solution is aqueous ferrous sulfate solution; such a method wherein the starting wood is selected from the group consisting of *Juglans nigra, Juglans hindsii, Juglans regia,* and *Juglans cinerea;* such a method wherein the vacuum is drawn to below about 50 mm of mercury; such a method wherein the vacuum is drawn to between about 0.025 mm and 0.001 mm of mercury; such a method wherein the temperature of the vessel during the vacuum step is preferably maintained between about 100° and 150° F.; such a method wherein the time of standing in the vacuum step is between about 3 and about 24 hours; such a method wherein the concentration of aqueous iron salt solution is between about 6 and up to about 18% by weight; such a method wherein the concentration of the ferrous sulfate solution is between about 8 and about 12% by weight; such a method wherein the pressure maintained during the pressure step is between about 200 and about 800 pounds per square inch; such a method wherein the temperature in the reaction vessel during the pressure step is preferably maintained between about 100° and 250° F.; such a method wherein the time of standing during the pressure step is between about 3 and about 48 hours; such a method wherein the temperature in the reaction vessel during the pressure step is preferably maintained between about 100° and 150° F. such a method wherein the aqueous iron salt solution is preheated before introduction into the vessel; and such a method wherein the aqueous ferrous sulfate solution is preheated to between about 100° and 150° F. before introduction into the reaction vessel; such a process wherein the vacuum is reapplied over a period of about three to eight hours; such a process wherein the pressure is reaplied over a period of about three to eight hours; and, finally, the product wood of the genus Juglans which is characterized by being jet black throughout its entire structure and substance except for bronze highlights, thereby constituting a highlighted jet black ebony substitute, and especially such a product having a "built-in" finish, thus requiring only sanding, waxing, and buffing to impart a high sheen.

GENERAL DESCRIPTION OF THE INVENTION

According to the present invention, it has now been found that the impregnation of species of wood of the genus Juglans, which have a satisfactorily-high natural tannin content, with a solution of an iron salt, particularly but not limited to ferrous sulfate, especially under certain preferred operating conditions and along with certain preferred additional steps, will effectively create a jet-black wood with bronze highlights which duplicates the fineness, uniformity, depth, and intensity of color of the finest highlighted natural ebony, and which may in addition possess other desirable characteristics which are imparted thereto by the process, thereby providing a highlighted synthetic ebony substitute.

In one embodiment of the present invention, lumber of the species *Juglans nigra* is evacuated of all moisture and air and then impregnated with a ferrous sulfate solution having a concentration not greater than about eighteen percent (18%) by weight, followed by drying, thereby producing the heretofore-mentioned highlighted ebony substitute. The procedure used to accomplish this is critical and is fully explained in the detailed examples and elsewhere in this disclosure. The various species of Juglans, especially but not limited to *Juglans nigra,* are particularly applicable to the present invention. *Juglans nigra* is commonly known as American Black Walnut, American Walnut, or Walnut, and is hereinafter sometimes referred to simply as "walnut". Walnut is a heavy, hard, strong, stiff, durable wood with good shock resistance and good dimensional stability and machinability (10). It has attractive figure and texture. It is available in large dimensions, in grades which are virtually defect free. There is an ample supply of walnut as annual production of walnut lumber in the United States averages about 34,000,000 board feet (5). There has in fact been a surplus of walnut lumber in recent years (6).

All of the desirable characteristics of walnut are retained in the heretofore-mentioned highlighted ebony substitute which is one embodiment of the present invention. In addition, certain characteristics of walnut are improved upon. The hardness of the material is ten to fifteen percent greater than natural walnut. The susceptibility to polish is greatly enhanced and is similar to that of natural ebony. The machinability of the material is enhanced as it has been found to cut cleaner than natural walnut. Cuts made with high speed cutting machines, such as shapers, leave a very smooth and clean surface free of the fuzzy-like texture often encountered in natural walnut, particularly in end grain cuts. Sanding properties of the material are good and are not adversely affected by the treatment process. Durability of the material is increased due to a greater resistance to wood-destroying organisms which is imparted to the material by the impregnated chemicals, and it is characterized by an advantageously greater water resistance than walnut itself.

The ample supply of walnut lumber, which would translate into an ample supply of the highlighted ebony substitute of the present invention, at a modest cost relative to ebony, and in large dimensions virtually free of defect, will effectively overcome the obstacles currently preventing the widespread use of natural ebony.

Complete impregnation of the subject wood is essential to impart the desired highlighted jet-black color and other characteristics throughout the entire structure and substance of the wood. The present invention provides a method to achieve complete impregnation. This method involves the use of vacuum, preferably heat, and pressure and is fully explained in the detailed examples and elsewhere in this disclosure.

In general, the method or process of the present invention is conducted in a single stage. The concentration of the reagent employed is a factor. When the concentration is in the ranges as specified herein, then the jet-black ebony substitute can be produced having bronze highlights.

In more detail with respect to the method of the invention, and the results obtained by employing the same, and varying the concentrations of reagent and other conditions employed in the method, it is to be noted as follows:

According to the single-stage method of the present invention, involving as it does a plurality of steps, the wood of the genus Juglans is treated to change its color completely and throughout the entire structure and substance thereof essentially to jet black, with bronze highlights, by placing the starting wood into a vacuum/pressure vessel and drawing a vacuum in the vessel. The vacuum drawn in the vessel is preferably below 50 mm of mercury, and most preferably between 0.025 mm and 0.001 mm of mercury. The temperature of the contents of the vessel is then preferably raised, preferably to a temperature between about 100° and 150° F. From an economic standpoint, the employment of an elevated temperature is highly desirable, but where plant and tank availability presents no problem may be dispensed with in favor of a more protracted period of standing under vacuum. The vessel is then allowed to stand, until essentially all the extractable water and air is extracted from the wood, this ordinarily requiring a time period between about 3 and about 24 hours. During this time the vacuum is preferably monitored by means of a vacuum gauge and the vacuum reapplied at intervals over a period of several hours, e.g., over a period of 3 to 8 hours, until a stable equilibrium is obtained as evidenced by a stable vacuum gauge reading. As already stated, this stable vacuum gauge reading is preferably obtained at a vacuum below about 50 mm of mercury and most preferably between 0.025 mm and 0.001 mm of mercury.

The point at which essentially all of the extractable water and air is extracted from the wood is readily determined by the observation of the vacuum gauge and, after reapplication of vacuum at intervals over a period of several hours during the vacuum step, the stable equilibrium as evidenced by a stable vacuum gauge reading is also evidence of the fact that essentially all of the extractable water and air has been extracted from the starting wood.

Then, an aqueous solution of an iron salt, preferably ferrous sulfate, is introduced into the vessel while maintaining the vacuum therein, the concentration of the aqueous iron salt solution being not grater than about eighteen (18) percent by weight, preferably from about six to about eighteen percent by weight, and most especially between about eight and twelve percent by weight. The temperature of the solution introduced into the vessel is preferably, but not necessarily, raised, representatively to a temperature between about 100° and 150° F. The employment of a preheated solution is advantageous although not essential.

Thereafter an elevated temperature is preferably maintained in the vessel and an elevated pressure is applied inside the vessel. This elevated pressure is preferably between about 200 and 800 pounds per square inch. The same temperature considerations apply here as in the vacuum step.

The vessel is thereupon allowed to stand for a further period until essentially the maximum possible amount of the iron salt solution is absorbed by the wood. This generally involves a time period of between about 3 and about 48 hours. During this time the pressure is advantageously monitored and pressure reapplied at intervals over a period of several hours, e.g., 3–8 hours, until the pressure stabilizes as indicated by a stable pressure gauge reading. As already stated, this stable pressure gauge reading is preferably obtained at a pressure between about 200 and 800 pounds per square inch.

The elevated temperature preferably maintained inside the vessel during this period is preferably between about 100° and 250° F., most advantageously between about 100° and 150° F. When the pressure gauge stabilizes, this indicates that the maximum possible amount of the iron salt solution has been absorbed by the wood.

The temperature of the contents of the vessel is then if necessary reduced to ambient, the pressure in the vessel released, the fluid drained from the vessel, the wood removed from the vessel, the wood washed with water, the thus-treated wood air dried and preferably also kiln-dried to produce a jet black synthetic ebony product having bronze highlights. The wood is preferably dried to a 6 to 12 percent EMC value and, when subjected to the usual surface treatments, such as sanding, buffing, lacquering, and/or waxing, as further indicated by the Examples, presents an outstanding finish which is remarkably like that of natural ebony in the form in which bronze highlights are present, as is well known to be the case with much natural ebony lumber and products made therefrom, having a so-called "built-in" finish which accepts a high sheen from mere waxing and buffing without more.

In both the vacuum step and the pressure step, the time the vessel is allowed to stand under vacuum or pressure is generally at least three hours and, depending upon the degree of vacuum and pressure and temperature applied, and the rapidity of the interval at which it is reapplied, may vary between about the minimum of three hours and the maximum as set forth in the foregoing, the entire procedure depending of course to some extent upon the condition and the size of the starting lumber treated, it being apparent to one skilled in the art that the smaller the size of the lumber treated the less stringent the conditions required and the less time required for each of the several steps.

It is accordingly to be noted that, when operating according to the single-stage method of the present invention, to produce a synthetic ebony product which is jet black with bronze highlights, the utilization of an aqueous iron salt solution having a concentration not greater than about eighteen percent (18%) by weight and evacuation of essentially all of the extractable water and air from the starting wood, together with introduction of essentially the maximum possible amount of iron salt solution by absorption into the wood, are essential aspects of the invention, the latter two conditions being readily determined by monitoring the vacuum and pressure gauges during the respective steps of the method and preferably reapplying the vacuum or pressure at intervals over a period of time until a stable equilibrium is obtained, as evidenced by a stable vacuum or pressure gauge reading, which is in turn indicative of the fact that essentially all of the extractable water and air has been extracted from the wood and the fact that essentially the maximum possible amount of iron salt solution has been absorbed by the wood. Further details of the method and product of the invention will be apparent from the detailed Examples which follow.

DETAILED DESCRIPTION OF THE INVENTION

The invention will be more fully understood by reference to the following detailed Examples, which are given by way of illustration only and are not to be construed as limiting.

EXAMPLE 1

A $1\frac{3}{4}$ in.×$4\frac{1}{4}$ in.×20 in. American walnut board, kiln dried to 6 percent equilibrium moisture content (EMC), was placed in a vacuum/pressure vessel. A vacuum of 0.001 mm Hg was drawn by means of a two-stage rotary vane type vacuum pump. Heat was applied to the vessel by means of an electric heat strap placed around the vessel and the temperature of the vessel and its contents was raised to 150° F. The vessel was allowed to stand for a period of 12 hours, by which time the vacuum gauge had stabilized. At the end of this 12 hour period, a ten percent (10%) aqueous solution of ferrous sulfate (by weight), carefully filtered and heated to 150° F., was introduced into the vessel, while maintaining the vacuum. Pressure of 500 lbs. per square inch was then applied inside the vessel by means of a hydraulic pump. Heat was applied to the vessel and the temperature of the vessel and its contents was maintained at 150° F. The vessel was allowed to stand for a period of 24 hours, by which time the pressure had stabilized. At the end of this 24 hour period, the temperature was lowered to the ambient level and the pressure inside the vessel released. The vessel was drained of the ferrous sulfate solution and the walnut board removed. The board was washed in plain water and allowed to air dry for one day. The board was then kiln dried to an EMC of 6 percent.

The board was then sawn across its width at one inch intervals for one-half of its length and was found to be completely jet black in color with bronze highlights throughout. The remaining one-half of the board was sawn through the center of its length and also found to be the same color throughout. The edges exposed in the previous step were sanded and lacquered. The finished wood exhibited a black color with bronze highlights of the same intensity and quality as that of the finest natural ebony samples, of the species Diospyros spp., that could be obtained, and the color did not bleed or fade.

The following Examples are identical to EXAMPLE 1 except for variations as noted:

EXAMPLE 2

During the vacuum step of the treatment, a vacuum gauge was monitored. It was observed that, after an initial vacuum of 0.025 mm Hg to 0.001 mm Hg was drawn, the gauge reading slowly rose. This was determined to be caused by the slow escape of trapped air and moisture from the wood. It was found that the reapplication of the vacuum pump, repeated at 30-minute intervals, over a period of 3 to 4 hours, eventually resulted in a stable vacuum gauge reading at the desired level of 0.025 mm Hg to 0.001 mm Hg. It was deduced that, at this point, using the given procedure, the maximum possible amount of air and moisture had been extracted from the wood, rendering it in the best possible condition to be impregnated with a fluid in the next step of the treatment procedure.

Likewise, during the ferrous sulfate/pressure step of treatment, a pressure gauge was monitored. It was observed that, after an initial pressure of 200 to 800 lbs. per square inch was applied, the gauge reading slowly dropped. This was determined to be due to the slow absorption of the fluid by the wood and to the fact that a period of time was required for the fluid to work completely into the wood structure. It was found that the reapplication of pressure, repeated at 30-minute intervals over a period of 3 to 8 hours, eventually resulted in a stable pressure gauge reading at the desired level of 200 to 800 lbs. per square inch. It was deduced that at this point, using the given procedure, the maximum possible impregnation of the wood structure had occurred.

Results were the same as in Example 1. The characteristics of the product were equal to those of the product of Example 1 or superior thereto.

EXAMPLE 3

A temperature of 225° F. is used in the ferrous sulfate step of treatment. Results obtained are similar to those of Example 1.

EXAMPLE 4

A period of 24 hours was used in the vacuum step, and 48 hours was used in the ferrous sulfate step. The results obtained were similar to those of Example 1.

EXAMPLE 5

Pressure of 800 lbs. per square inch is applied in the ferrous sulfate step. The results obtained are similar to those of Example 1.

EXAMPLE 6

A sample of the wood product obtained in Example 1 was sanded to a very smooth finish. A high quality wood wax was applied to the sanded surfaces and allowed to dry. The wood was then buffed on a lathe using 12-inch cotton buffs turning at 1200 RPM. A very high sheen was obtained. It was a much higher sheen than that possible to obtain on natural walnut and was similar to that possible to obtain on natural ebony. The product had a "built-in" finish in that it required only waxing and buffing, even without application of lacquer or oil.

EXAMPLE 7

A sample of the wood product obtained in Example 1 was cut to a size of $1\frac{1}{2}$ in. $\times$ $1\frac{1}{2}$ in. $\times$ $\frac{1}{2}$ in. and placed in an airtight sterilized jar in which a sample of moistened earth had been placed. A second jar, identical to the first, was prepared and an untreated walnut sample, identical in size to the treated sample, was placed in it. After a period of several months it was observed that the untreated walnut had a mold growth on its surface, while the treated walnut had no growth upon it.

EXAMPLE 8

An 18 percent aqueous solution of ferrous sulfate was used. The results obtained were similar to those of Example 1.

EXAMPLE 9

An 8 percent solution of ferrous sulfate was used. The results obtained were similar to those of Example 1.

EXAMPLE 10

Following Example 2, a temperature of 250° F. is used in the ferrous sulfate step of treatment. Results obtained are similar to those of Example 1.

EXAMPLE 11

Following Example 2, a period of 10 hours was used in the vacuum step, and 20 hours was used in the ferrous sulfate step. The results obtained were similar to those of Example 1.

EXAMPLE 12

Following Example 2, a pressure of 200 lbs. per square inch was applied in the ferrous sulfate step. The results obtained were similar to those of Example 1.

EXAMPLE 13

Following Example 2, a 12 percent aqueous solution of ferrous acetate was used. The results obtained were similar to those of Example 1.

EXAMPLE 14

Following Example 2, a 12 percent aqueous solution of ferrous sulfate was used. The results obtained were similar to those of Example 1.

EXAMPLE 15

Following Example 2, a 6 percent aqueous solution of ferrous sulfate is used. The results obtained are similar to those of Example 1.

EXAMPLE 16

Following Example 2, a 10 percent aqueous solution of ferrous chloride is used. The results obtained are similar to those of Example 1.

EXAMPLE 17

A sample of the wood product obtained in Example 1 was fashioned into a letter opener having an approximate length of $9\frac{1}{2}$ inches, handle width of one inch, and handle thickness of 11/32 inch. The blade of this letter opener was tapered to a rounded point of approximately 3/16 inch diameter and thickness of 0.090 inch. A similar letter opener was fashioned of untreated walnut. Both samples were put through six complete cycles of an automatic dishwashing machine, both at the same time, with complete drying of the samples between dishwasher cycles. The untreated walnut sample was found to have significant warpage of the blade and "raised grain" on the handle. The treated sample was found to have no noticeable effects from the dishwasher cycles, other than slight dulling of the surface which was readily removed by hand buffing.

ADDITIONAL EXAMPLES

When the procedure of the preceding examples is repeated, employing instead of the American Walnut (*Juglans nigra*) wood as starting material, numerous other species of Juglans, including Claro Walnut (*Juglans hindsii*), Circassian Walnut (*Juglans regia*), and *Juglans cinerea*, the results are essentially the same as set forth in the preceding examples except for slight differences in the grain of the wood as would be expected from the differences in the starting materials employed.

When the ferrous sulfate solutions employed in the preceding examples are replaced by other ferrous or ferric salt solutions, such as ferrous acetate, ferrous chloride, or ferric chloride, or the like, the results are essentially the same although ferrous sulfate solutions are preferred. Expected variations within the range of concentrations of the iron salt are experienced, for example, it is usually desirable to employ a solution of ferrous acetate relatively high in the specified concentration range rather than relatively low in the specified concentration range to obtain the same result as is achieved with a corresponding ferrous sulfate solution.

COMPARATIVE EXAMPLES

A. White wood (maple) was treated with tannic acid, followed by ferrous sulfate, exactly in accord with the disclosure of Spade, U.K. Patent No. 152,427 of 1919–1920, mentioned in the foregoing. Although the thickness of the wood treated was only approximately one-quarter of an inch, it was impossible to impart a color throughout the body of the wood, even upon long standing over a period of many days. Moreover, only a light gray depth of color could be obtained, and absence of color from the surface of the product was apparent in numerous areas of the final product. The depth of color could not be substantially improved by waxing and/or polishing according to usual surface-finishing procedure. The material was totally unsuitable as an ebony substitute, even of a most inferior type or grade, even when so finished.

B. Black dyed laminated veneer, marketed as archery bow handle stock, was examined from the standpoint of its depth of color, completeness of color and its suitability as an ebony substitute. Unimpregnated areas were apparent throughout the material, on the surface thereof as well as in a cross section of the veneer itself, and only a pale gray color characterized the product. The pale gray color could not be substantially improved or darkened by normal waxing or polishing procedure. The material, even when so finished, was totally unsuitable as any kind of an ebony substitute.

When "equilibrium moisture content" or "EMC" is used herein, this refers to the moisture content at which the wood is neither gaining nor losing moisture. Accordingly, an equilibrium condition has been reached. There is a definite relationship between equilibrium moisture content, relative humidity, and temperature, and this is well understood in the art, as indicated, for example, on pages 3-6 and 3-7 of the U.S. Forest Products Laboratory publication entitle "Wood Handbook: Wood as an Engineering Material" (1974) otherwise identified as U.S.D.A. Agr. Handb. 72, rev., obtainable from the Superintendent of Documents, U.S. Government Printing Office, Washington, D.C. 20402 as stock number 001-000-03200-3.

It is thereby seen from the foregoing that the objects of the present invention have been accomplished and that a suitable and satisfactory highlighted jet-black ebony substitute, having full and complete ebony coloring throughout its entire structure and substance, has been provided thereby, as well as an economic and commercially practicable method for the production thereof, and whereby all of the previously-mentioned objectives have been attained.

Although the preferred embodiments of the invention have been illustrated and described in the foregoing description, it is to be understood that the intention is not limited to the embodiments disclosed or to the exact details of operation or exact compounds, compositions, method or procedures shown and described, since the invention is capable of numerous modifications, rearrangements, and substitutions of parts and elements and other equivalents, both chemical and physical, without departing from the spirit or scope of the invention, as will readily be apparent to one skilled in the art, and the invention is therefore to be limited only by the full scope which may be legally accorded to the appended claims.

I claim:

1. A method of treating wood of the genus Juglans to change its color completely and throughout the entire structure and substance thereof essentially to jet black, with bronze highlights, consisting essentially of the following steps:

placing the starting wood into a vacuum/pressure vessel drawing a vacuum in the vessel to below about 50 mm of mercury, allowing the vessel to stand for a period between about and 24 hours at a temperature between about 100° and 150° F. until essentially all the extractable water and air is extracted from the wood, introducing an aqueous solution of n iron salt having a concentration between about six (6) and not greater than about eighteen (18) percent by weight into the vessel, while maintaining the vacuum therein, thereafter applying an elevated pressure inside of the vessel between about 200 and about 800 pounds per square inch, allowing the vessel to stand for a period between about 3 and about 48 hours at a temperature between about 100° and 250° F. until essentially the maximum possible amount of iron salt solution is absorbed by said wood, releasing the pressure in the vessel, draining fluid from the vessel, removing the wood from the vessel, washing the wood with water, and drying the thus-treated wood to produce a jet black synthetic ebony product having bronze highlights.

2. The method of claim 1, wherein the vacuum is monitored by means of a vacuum gauge during the vacuum step of the method and wherein the vacuum is reapplied at intervals over a period of several hours until a stable equilibrium is obtained as evidenced by a stable vacuum gauge reading.

3. The method of claim 2, wherein the pressure is monitored during the pressure step of the method and wherein the pressure is reapplied at intervals over a period of several hours until the pressure stabilizes as indicated by a stable pressure gauge reading.

4. The method of claim 1, wherein the aqueous iron salt solution is aqueous ferrous sulfate solution.

5. The method of claim 1, wherein the starting wood is selected from the group consisting of *Juglans nigra, Juglans hindsii, Juglans regia,* and *Juglans cinerea.*

6. The method of claim 2, wherein the vacuum is drawn to between about 0.025 mm and 0.001 mm of mercury.

7. The method of claim 4, wherein the concentration of the ferrous sulfate solution is between about 8 and about 12% by weight.

8. The method of claim 3, wherein the temperature maintained in the reaction vessel during the pressure step is between about 100° and 150° F.

9. The method of claim 1, wherein the aqueous iron solution is preheated before introduction into the vessel.

10. The method of claim 9, wherein the aqueous ferrous sulfate solution is preheated to between about 100° and 150° F. before introduction into the reaction vessel.

11. The method of claim 2, wherein the vacuum is reapplied over a period of about three to eight hours.

12. The method of claim 3, wherein the pressure is reapplied over a period of about three to eight hours.

13. A method of treating wood of the genus Juglans to change its color completely and throughout the entire structure and substance thereof essentially to jet black, with bronze highlights, consisting essentially of the steps of introducing the starting Juglans wood into a vacuum/pressure vessel, drawing a vacuum in the vessel, allowing the vessel to stand at an elevated temperature until essentially all of the extractable water and air are extracted from the wood, and impregnating the wood with an aqueous solution of an iron salt at an elevated temperature and pressure to cause blackening of the wood essentially throughout, and drying the thus-treated wood to produce a jet black product with bronze highlights.

14. Wood of the genus Juglans characterized by being jet black throughout its entire structure and substance except for bronze highlights.

15. Wood of the genus Juglans characterized by being jet black throughout its entire structure and substance except for bronze highlights, thereby constituting a high-lighted jet-black ebony substitute.

16. The product of claim 15, having a high sheen, being sanded, waxed, and buffed.

* * * * *

UNITED STATES PATENT AND TRADEMARK OFFICE

CERTIFICATE OF CORRECTION

PATENT NO. : 4,840,637

DATED : June 20, 1989

INVENTOR(S) : Philip C. Rolffs

It is certified that error appears in the above-identified patent and that said Letters Patent is hereby corrected as shown below:

Col. 2, line 44; "gray black" should read -- gray-black --

Col. 3, line 39; "dye resin" should read -- dye-resin --

Col. 5, lines 56 & 57; delete "in addition to color," (second occurrence)

Col. 12, line 19; after "percent" insert -- aqueous --

Col. 13, line 67; "entitle" should read -- entitled --

Col. 14, line 16; "intention" should read -- invention --

Col. 14, line 39; after "about" (first occurrence) insert -- 3 --

Col. 14, line 42; "n" should read -- an -- (Preliminary (Amendment dated 6/02/88, old claim 22, line 14)

Col. 16, lines 22 & 23; delete "thereby constituting a high-lighted jet-black ebony substitute" and insert -- produced according to the method of Claim 13 --

Signed and Sealed this

Twenty-eighth Day of August, 1990

*Attest:*

HARRY F. MANBECK, JR.

*Attesting Officer*

*Commissioner of Patents and Trademarks*